US007178261B2

(12) United States Patent
McCambridge et al.

(10) Patent No.: US 7,178,261 B2
(45) Date of Patent: Feb. 20, 2007

(54) AIR PULSING ATTACHMENT FOR HANDHELD DRYER

(75) Inventors: James McCambridge, Polo, IL (US); Luther D. Langley, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 200 days.

(21) Appl. No.: 10/794,195

(22) Filed: Mar. 5, 2004

(65) Prior Publication Data

US 2005/0193584 A1 Sep. 8, 2005

(51) Int. Cl.
*A45D 20/00* (2006.01)

(52) U.S. Cl. ..... 34/96; 34/97; 219/222; 392/380; 392/384; 392/385

(58) Field of Classification Search ..... 34/96, 34/97; 132/212; 392/379–385; 219/222
See application file for complete search history.

(56) References Cited

U.S. PATENT DOCUMENTS 4,019,260 A * 4/1977 Levy et al. ..... 34/97
5,317,815 A 6/1994 Hwang ..... 34/97
5,689,896 A 11/1997 Smetana ..... 34/97
5,720,107 A * 2/1998 Rolf et al. ..... 34/97
5,841,943 A 11/1998 Nosenchuck ..... 392/385

FOREIGN PATENT DOCUMENTS

CH 682293 A5 * 8/1993
EP 0 391 495 A 10/1990
WO WO 2004/006713 A1 1/2004

* cited by examiner

*Primary Examiner*—Jiping Lu
(74) *Attorney, Agent, or Firm*—Greer, Burns & Crain, Ltd.

(57) ABSTRACT

An air pulse attachment for a handheld dryer includes a shell defining a passage within the shell. The passage in the shell communicates the dryer with an outlet. A pulse valve is pivotably disposed in the passage and has a pivot axis. At least one deflection member is associated with the outlet of the shell and is rotatable with respect to the pivot axis. The at least one deflection member is configured for deflecting the air from the dryer.

20 Claims, 5 Drawing Sheets

AIR PULSING ATTACHMENT FOR HANDHELD DRYER

BACKGROUND OF THE INVENTION

The present invention is related to attachments for handheld dryer devices such as hair dryers and the like, and specifically to attachments for handheld dryers that pulse emitted air from the handheld dryers.

Handheld dryers such as hair dryers are generally known in the art. Typically they include a housing having an interior, a handle, and a barrel. An impeller is enclosed in the housing for forcing air at an increased velocity out of the barrel. A heater such as an electric coil is typically contained in the barrel for heating the air as it passes by. In operation, a user such as a hairstylist may direct the barrel in a desired direction to exploit the heated air flowing therethrough to dry the hair of a customer, for example.

Drying occurs as moisture is removed by the heated air. The speed at which a wet object such as hair may be dried generally depends on the capacity of the heated air to absorb moisture and the volumetric flow rate of the heated air contacting the wet object. For general purposes, the capacity of heated air to absorb moisture is determined by its relative humidity and its temperature. Although handheld dryers are generally known, problems and unresolved needs in the art remain. By way of example, non-uniform drying of the hair can occur, particularly near the roots. Further, the hair and the scalp can be overheated or dried out by a constant air current emitted from the hair dryer. Since the volumetric and velocity output of dryers are generally fixed depending on factors such as the impeller power and speed, the barrel configuration, air inlet size, and the like, the capability of the dryer to uniformly dry hair without overheating the hair and the scalp is generally limited.

Some attempts have been made to prevent overheating the hair and the scalp while attaining uniform dryness of the hair. To date, however, these attempts have met with only limited success. For example, some dryers are provided with impellers that are operable at different speeds to provide some variance in output. This disadvantageously adds cost and complexity to the dryer, however. Additionally, the dryer is limited to the impeller speed settings provided, which typically include only two or three speeds. Also, diffuser attachments are known for releasably fastening on the outlet of conventional dryers for diffusing airflow and/or for reducing the velocity of the flow. These attachments have not been useful, however, to provide variable frequency and volumetric output.

Also, many prior art diffusers and other attachments disadvantageously increase the back pressure on the dryer motor, thereby taxing the motor. For example, attachment of prior art diffusers to a dryer can cause the RPM of the motor to increase by 6% or more. This tends to lower the efficiency of the motor, to increase utility costs, and to shorten the service life of the dryer.

Air pulsing attachments are also known and are configured for time dependent deflections of the emitted air. Pulsing the air current gently and more uniformly dries hair from root to tip without overheating or drying out the hair or scalp. However, different hair types and scalps require different frequencies and volumetric output of pulse and, typically, the pulse frequency and volumetric pulse output of prior art air pulsing attachments are not variable, or are only variable as to the impeller speed.

Accordingly, these and other unresolved needs remain in the art.

SUMMARY OF THE INVENTION

An exemplary attachment for a hand held dryer includes a shell releaseably attached to the barrel of a conventional dryer. A passage is defined within the shell between the barrel and an outlet of the shell for communicating the air emitted from the dryer with the outlet. A pulse valve is mounted in the passage and has a pivot axis about which the valve pivots. Associated with the outlet, a deflection member is rotatable with respect to the pivot axis.

The present air pulse attachment offers advantages and is useful in addressing unresolved problems of the prior art. For example, the present air pulse attachment varies the frequency of pulse of the airflow from a dryer. By way of additional example, the present attachment is configured for varying the volumetric flow of air within the pulse. These and other advantages of the invention will be better appreciated through consideration of the detailed description that follows.

More specifically, an air pulse attachment for a handheld dryer is provided which includes a shell defining a passage within the shell. The passage communicates the dryer with an outlet and a pulse valve is pivotably disposed in the passage and has a pivot axis. At least one deflection member is associated with the outlet of the shell and is preferably rotatable with respect to the pivot axis. The at least one deflection member is configured for deflecting the air from the dryer.

DETAILED DESCRIPTION

Figure 1:
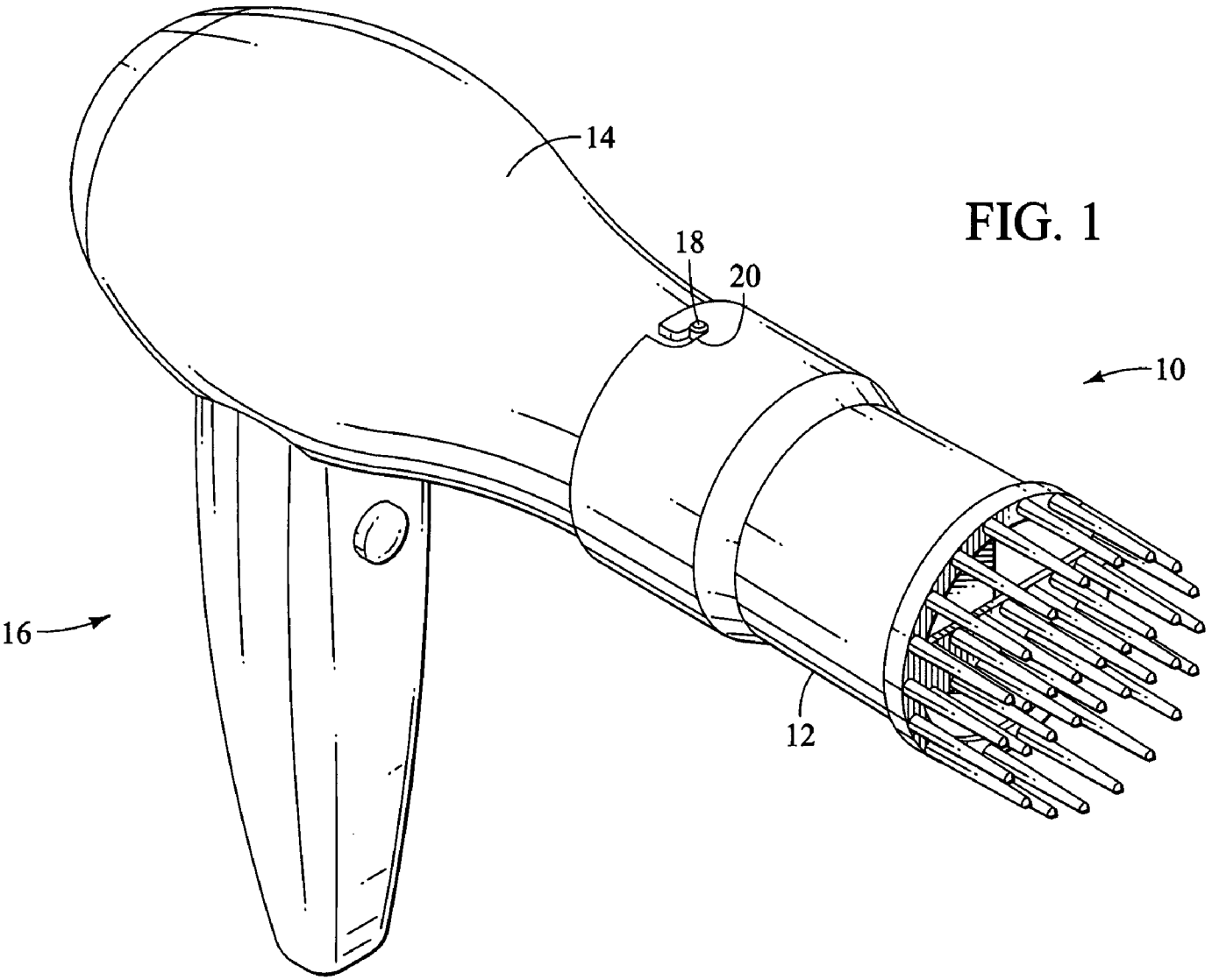
FIG. 1 is a top perspective view of the present attachment shown mounted on a handheld dryer.
Figure 2:
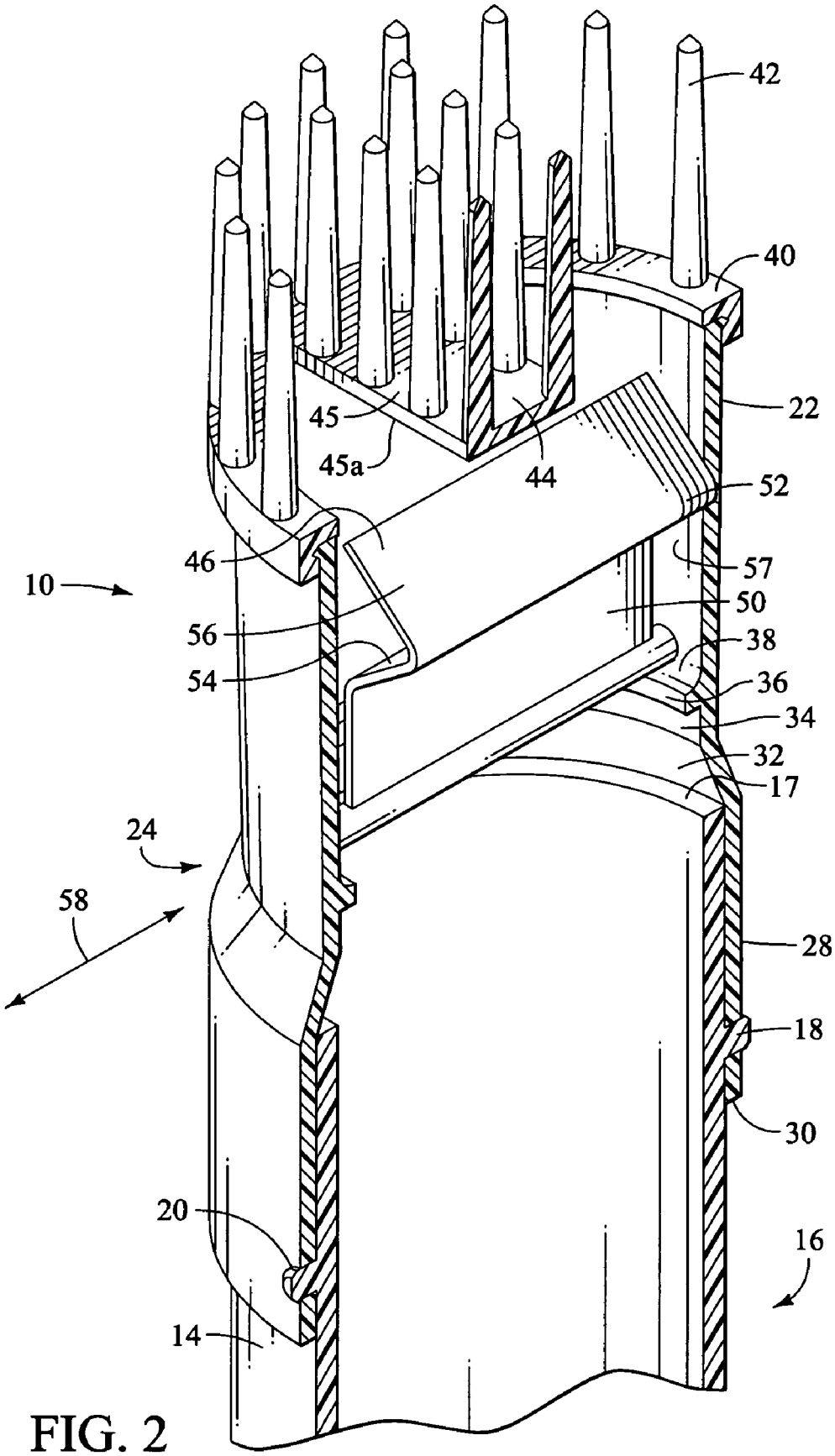
FIG. 2 is a partially cut-away perspective view of the present attachment shown on a handheld dryer.

Turning now to FIGS. 1 and 2, an exemplary embodiment of an air pulsing attachment is generally designated 10 and includes a generally tubular shell 12 that may be adapted to frictionally receive and engage a barrel or outlet structure 14 of a handheld dryer generally designated 16. As used herein, the term "tubular" is intended to broadly refer to a shape including two open ends that are connected by a wall that has a generally circular cross section. The diameter or configuration of the tube wall may vary along its length.

As best shown in FIG. 2, the generally cylindrical dryer nozzle end 17 of a dryer is located on the dryer barrel 14, which is removably contained within and secured to the shell 12. As such, the barrel 14 has a diameter that is less than an inner diameter of the shell 12. In the exemplary embodiment, the shell 12 is connected to the barrel 14 at an outside wall of the barrel. It is also contemplated that the dryer barrel 14 could fit over the shell 12 of the attachment 10.

It will be appreciated that the shell 12 may have a different configuration for fitting the particular geometry of the dryer barrel 14 to which it is attached. Other embodiments may be provided with adjustable barrel-receiving members so that the present attachment 10 may be attached to barrels 14 of different geometries. For example, a pliable material such as soft rubber or a polymer layer may be provided on fins or other members to provide some tolerance for barrels of different diameters. Additionally, receiving members such as an adjustable clamp or ring may be provided. The shell 12 may also be indirectly connected to the barrel 14, such as being connected through another member, for example, the dryer nozzle.

The air pulsing attachment 10 has a releasable locking arrangement which positively locates the attachment on the barrel 14 to provide adequate support and prevents unwanted disengagement of the attachment from the dryer barrel. To provide the desired releasable locking engagement between the barrel 14 and the attachment 10, at least one engagement formation 18 is provided on the barrel 14 for retaining the attachment 10 thereto and a corresponding at least one complementary formation 20 on the attachment. The at least one and preferably plurality of complementary formations 20 are preferably equal to the number of engagement formations 18 on the barrel 14. In the exemplary embodiment, the engagement formations 18 are radially extending lugs, and the complementary formations 20 are generally "J"-shaped bayonet-type notches or recesses disposed on the shell 12 of the attachment 10. Alternatively, engagement formations 18 and complementary formations 20 could be reversed in location. Thus, a bayonet-lug attachment formation is provided, as is known in the mechanical arts.

The shell 12 is attached to the dryer barrel 14, and the shape of the shell narrows to locate and prevent inward axial movement of the barrel within the shell. Accordingly, the barrel 14 extends to about midway along the length of the shell 12 and a portion of the shell is coextensive with the dryer barrel. As used herein, the term "coextensive" is intended to broadly refer to a general condition of having lengths that overlap one another. Preferably, the shell 12 is configured for removably attaching the shell to the dryer barrel 14 without substantially impeding flow through the barrel.

Referring now to FIGS. 2–8, a first or upper passage 22 is defined between a restriction passage generally designated 24 and an outlet 26 of the shell 12, and a second or lower passage 28 is defined between the restriction passage and a barrel-receiving end 30. For purposes herein, "upper" and "lower" and "first" and "second" are being used with reference to the passages 22 and 28 as configured and oriented in the attachment 10 as shown. It will be understood that the terms "upper," "lower," "first," and "second," are not intended to limit the present disclosure, and that other operational orientations may be achieved. For example, if the orientation of the attachment 10 were reversed, "upper" and "lower" could of course likewise be reversed. Also, the terms "first" and "second" could be used to describe either of the passages 22 or 28 in other embodiments. It will also be appreciated that the barrel 14 has been illustrated to more fully explain operation of embodiments of the present attachment 10, but that the barrel is not a part of the present attachment.

When the dryer barrel 14 is secured in the shell 12 preferably by friction and the formations 18, 20, the upper passage 22 and the restriction passage 24 are in fluid communication, the upper passage is open to the atmosphere at the outlet 26. Forming a seal with the shell 12, the barrel 14 prevents the lower passage 28 from being in fluid communication with the remainder of the shell 12, the lower passage 28 preferably securely enclosing the barrel 14.

The shell 12 defines the restriction passage 24 downstream of the nozzle end 17 in which air flowing from the dryer barrel 14 is forced through a contraction portion 32 to a channel 34 having a reduced diameter. The restriction passage 24 includes the contraction portion 32, the channel 34, a neck 36 and an expansion portion 38. In the preferred embodiment, the restriction passage 24 is larger at the contraction portion 32 adjacent the dryer barrel 14, and tapers to a reduced diameter at the channel 34. Adjacent the channel 34, the neck 36 having a further reduced diameter is, in turn, disposed adjacent the expansion portion 38, which increases in diameter. Located between the expansion portion 38 and the outlet 26 is the upper passage 22, in the preferred embodiment having a diameter slightly smaller than that of the lower passage 28. The relative diameters of the passages 22, 24 and 28 are not critical.

In operation, the air pulsing attachment 10 is operable when attached to the dryer 16, which provides the volumetric flow of air used for drying hair. Generally, and with reference to FIGS. 3–8 by way of illustration, air exits the dryer barrel 14, and flows through the shell 12 in a pipe-flow fashion. The velocity of the air increases and the air pressure decreases as the air passes through the contraction portion 32. The air then flows through the channel 34 under decreased pressure and through the neck 36 with further increased velocity and under further decreased pressure. As the air passes through the restriction passage 24, a pressure differential is created as air is forced to flow through a reduced volume at an increased velocity. The air then passes through the expansion portion 38, suddenly decreasing in velocity and increasing in pressure. The air travels out of the upper passage 22 through the outlet 26 at an atmospheric pressure, where the air may be directed at the object to be dried.

Located at the outlet 26, a ring 40 is preferably rotatably disposed on the shell 12 so that the flow of air through the outlet 26 is not impeded. The ring 40 may rotate on the shell 12 in a slot and groove formation, or any other configuration that allows relative rotation of the ring and the shell without impeding air flow. In the preferred embodiment, the ring 40 is thin in the direction of air-flow, having a plurality of comb teeth 42 extending from an outer surface 45 and configured for separating hair, massaging the scalp, and promoting uniform hair drying. It is contemplated that the arrangement, length, and number of the plurality of teeth 42 may vary to suit the application. It is also contemplated that the ring 40 may be fixed to the shell.

A relatively flat bar 44, or other deflection member, is preferably integrally formed with the ring 40. Bisecting the ring 40, the bar 44 also preferably has comb teeth 42 extending from the top surface 45, and preferably has a smooth bottom surface 45*a*. The bar 44 preferably has no apertures, holes or other formations on the bottom surface, and is configured for deflecting 100% of the incident airflow downward into the shell 12. Alternatively, the bar 44 may have non-planar projections or formations (not shown) to focus the angle of reflection of air down at a particular location in the shell 12. Together the flat bar 44 and the ring 40 preferably rotate at least 90-degrees relative to the shell 12. Alternatively, the bar 44 may move relative to a stationary ring, or may have another configuration in which the bar moves relative to the shell 12. Further, any other deflection member having any other shape and size, positioned generally adjacent the outlet 26, for deflecting air back at the shell 12 is contemplated.

Pivotably mounted in the upper passage 22, a pulse valve 46 is preferably formed from a relatively thin material that, in the preferred embodiment, has a width substantially extending the diameter of the passage, and has a length substantially extending the length of the passage. Forming a general "Z"-shape in cross-section, the valve 46 is made of a generally rigid material. A pivot 48 is provided on the pulse valve 46 and is configured for securing the valve in the upper passage 22 and enabling the pivoting action of the valve from side-to-side within the passage. Although the pivot 48 is illustrated as a pin and sleeve configuration, other types of pivoting attachments, such as a hinge, a ball joint or a lug and notch configuration, are contemplated. The size of the valve 46 may vary to suit the application, and may be sized relative to the dimensions of the barrel 14, relative to the dimensions of the shell 12, and relative to the power of the dryer 16.

Figure 4:
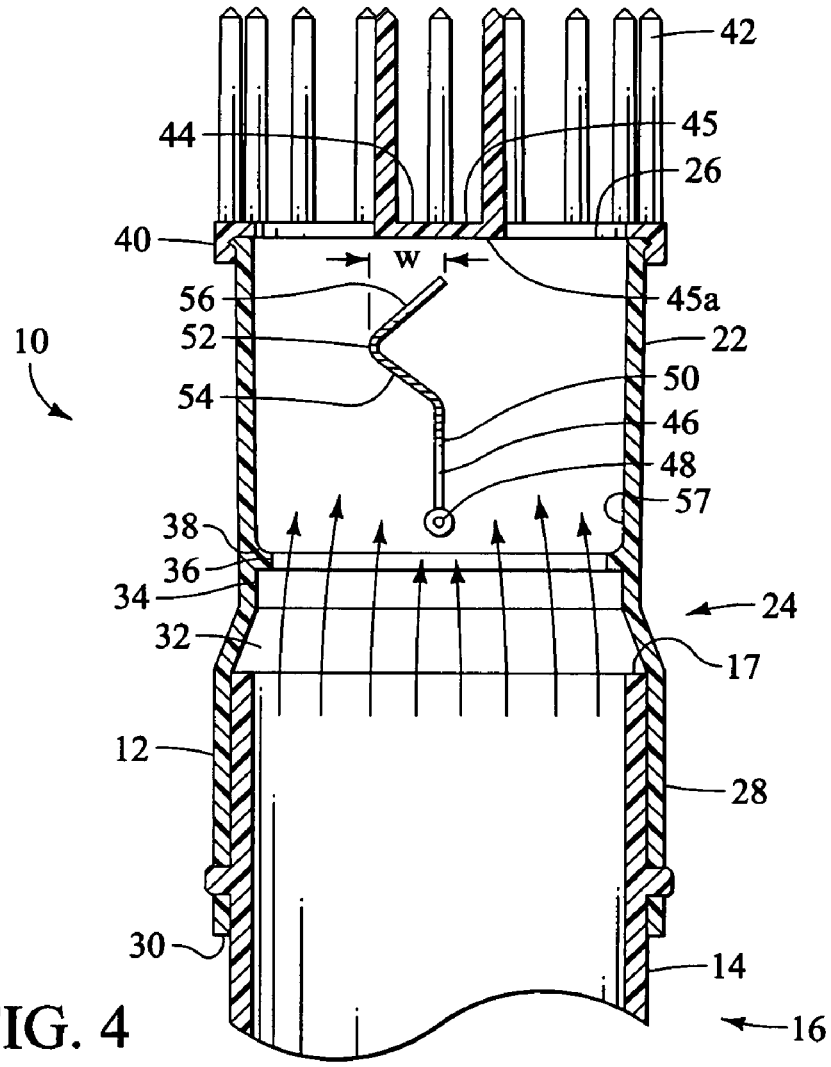
FIG. 4 is a cross-section taken along the line 4—4 of FIG. 3 and in the direction indicated generally.

Referring to FIG. 4, the pulse valve 46 is shown axially aligned with the passage 22, and has a lower portion 50 fixed to the pivot 48, and an upper portion 52 which is a free end. The upper portion 52 forms an "L" shape whose legs extend from each other at a substantially 90-degree angle. A first leg 54 is proximal the lower portion 50 and forms an approximately 45-degree angle therewith. A second leg 56 is at the free end and has substantially the same length as the first leg 54. Other configurations and relative sizes of the components 50, 54, 56 are contemplated.

Figure 6:
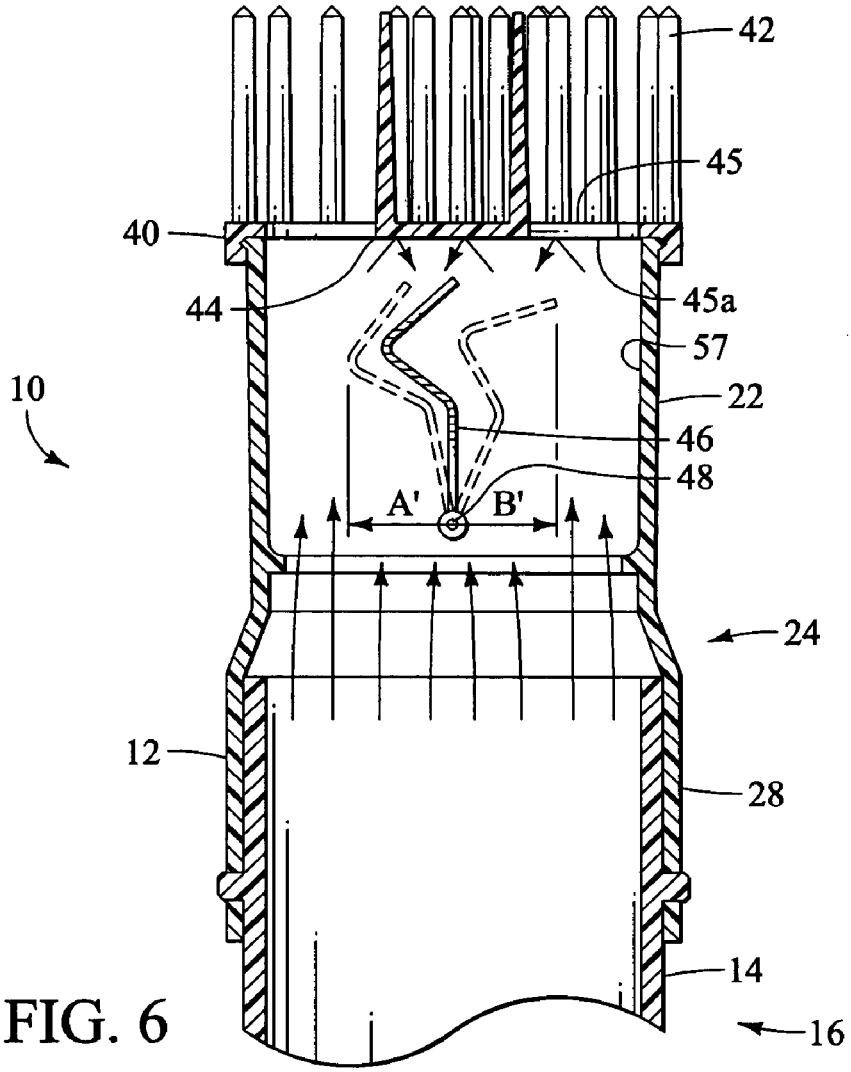
FIG. 6 is a cross-section taken along the line 6—6 of FIG. 5 and in the direction indicated generally.
Figure 8:
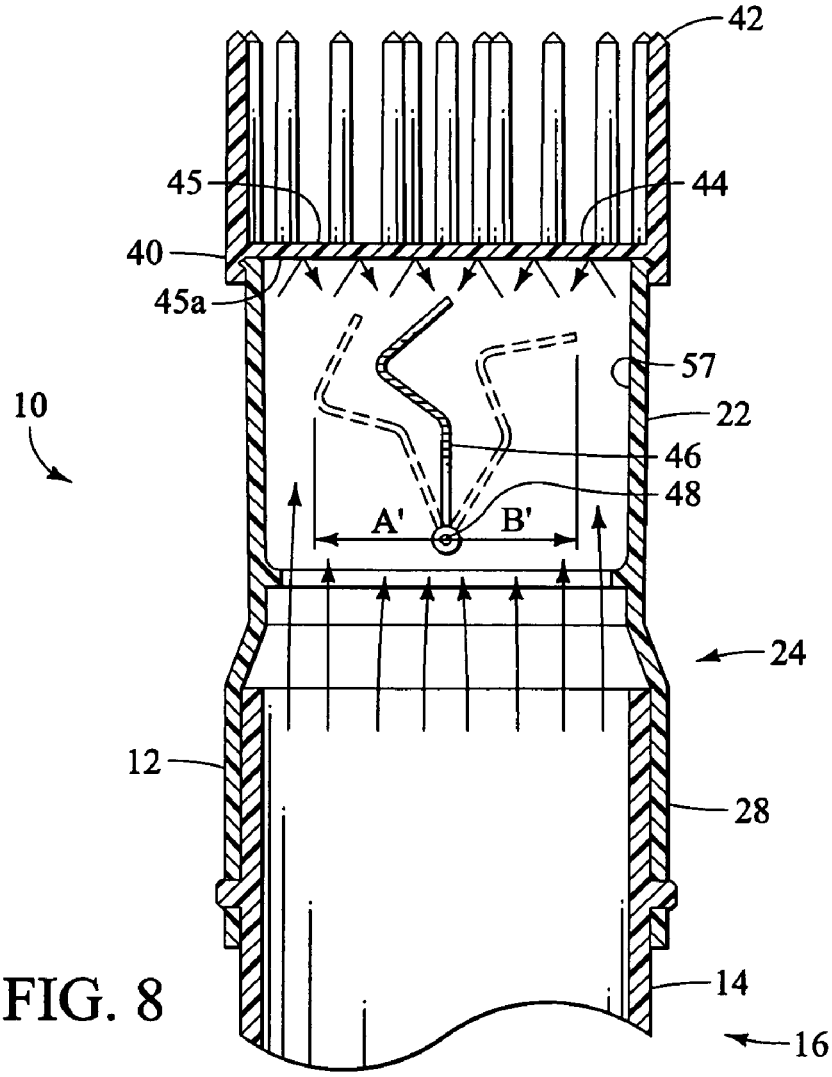
FIG. 8 is a cross-section taken along the line 8—8 of FIG. 7 and in the direction indicated generally.

Referring now to FIGS. 6 and 8, since the pulse valve 46 pivots from side-to-side in the passage 22 and relative to the shell 12, the valve has two vector components A' and B' in the radial direction of the upper passage 22, that are normal to the length of the pulse valve 46, and that are associated with the surface area of the valve that impedes air flow in the axial direction of the passage. The shape of the pulse valve 46 dictates how the valve oscillates within the passage 22 because A' and B' vectors provide the surface area upon which the flow of air from the dryer 16 acts upon to effect oscillation.

It is believed that the oscillation of the pulse valve 46 is a result of the air exiting the dryer and "pushing" on the valve in the upwards direction, and the air deflecting off the bar 44 and countering by "pushing" downwards on the valve. It is further believed that the surface area of the valve 46, represented by the vector components A' and B', is what is "pushed" by the air. The oscillation of the valve 46 results in what the user senses as intermittent pulses of air. Such pulses allow the hair and scalp to cool between pulses of hot air.

In addition to describing additional structure of the present attachment, the following description incorporates a description of the theory of how the attachment is believed to function.

When the dryer 16 is turned off, and there is no forced air flow through the shell 12, the pulse valve 46 rests against an inside wall 57 of the upper passage 22. When the dryer 16 is turned on, the air flows through the restriction passage 24 and into the upper passage 22 with the configuration of the shell 12, causing turbulent air flow. The air will experience a sudden decrease in velocity at the surface of the pulse valve 46 facing the flow, which will cause a rise in dynamic pressure along this same surface (for example, the surface area represented by vector A') causing a pressure drag. This pressure acting over an area results in a force that lifts the pulse valve 46 off of the inside wall of the upper passage 22 towards the center.

As the valve 46 pivots towards the center, the value of vector A' becomes smaller and smaller, until the valve pivots to the center, and eventually pivots to the other side of the passage where vector B' increases. As vector B' increases, more surface area of the valve 46 is being exposed to the air flow from the dryer 16 and, in turn, the force on the valve is increasing. At a certain amount of force, the momentum of the valve 46 is overcome, the valve pivots the other way, and vector B' starts to decrease as the valve pivots back towards the center.

It has been found that the valve 46 continues to oscillate in a see-saw fashion without dampening. A force countering the air from the hair dryer 16 is the force associated with the bar 44 located at the outlet 26, which deflects air back down at the valve 46. The amount of air deflected downwards towards the pulse valve 46 is a function of many different variables, but in general, the amount of surface area of the bar 44 that is out of alignment with the valve 46, the more air that is deflected back at the valve.

Figure 3:
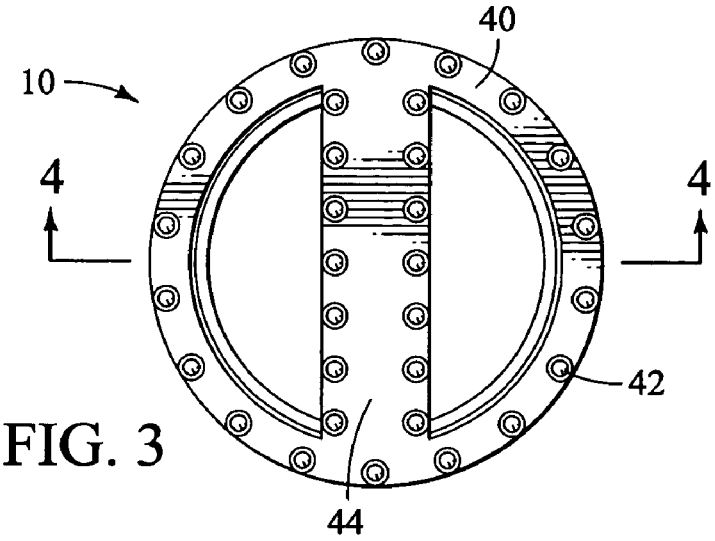
FIG. 3 is a top view of the present attachment shown in an aligned position.

FIGS. 3 and 4 depict a minimum state of oscillation of the pulse valve 46 which occurs when the bar 44 is generally radially aligned with a pivot axis 48 of the valve. The bar 44 has a width that is substantially the same as a width "w" of the "Z"-shape (as opposed to the width of the material forming the valve) in cross-section. Thus, when the pivot axis 48 and the bar 44 are generally aligned, as depicted in FIGS. 3 and 4, the air from the dryer hits the pulse valve 46, and the valve, in turn, prevents the air from deflecting off the bar because the air is acting on, as well as being impeded by, the valve during oscillation. Thus, without the counter "push" by the air deflected off the bar 44, the valve 46 substantially dampens out because there is no deflected air to maintain the momentum of the valve. Once dampened, the pulse valve 46 pivots negligibly or, alternatively, remains axially aligned with the passage 22.

Figure 5:
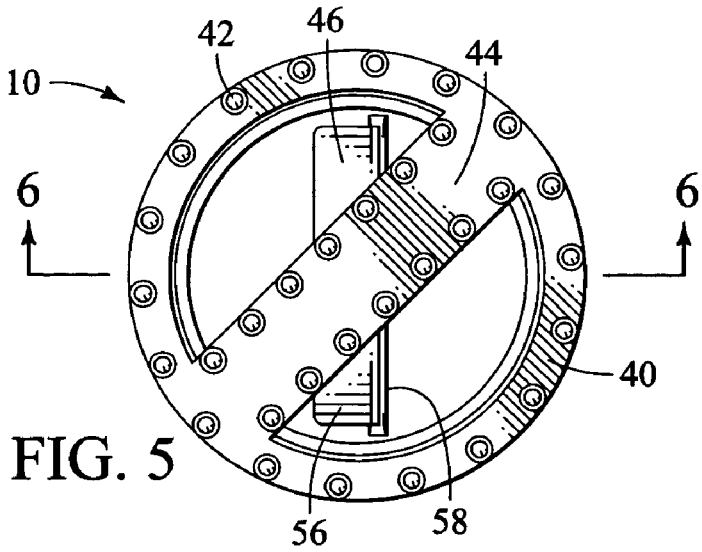
FIG. 5 is a top view of the present attachment shown in a 45-degree offset.

FIGS. 5 and 6 depict an intermediate state of oscillation of the pulse valve 46 which occurs between general coaxial alignment and a 90-degree offset, for example at a 45-degree offset. During oscillation, the surface area of the bar 44 which receives air current is increased because outer portions of the bar are out of alignment with the pivot axis 48. This means that air deflects off the bar 44 and counters the upward "push" by "pushing" down on the valve 46. The "push" down by the deflected air creates vectors A' and B'. The dryer 16 is continuing to "push" up as long as the dryer is on. At a certain amount of surface area represented by the vector components A' and B', an equilibrium is met between the "pushing" up by the dryer 16 and the "pushing" down by the deflected air, and the valve oscillates without dampening.

Figure 7:
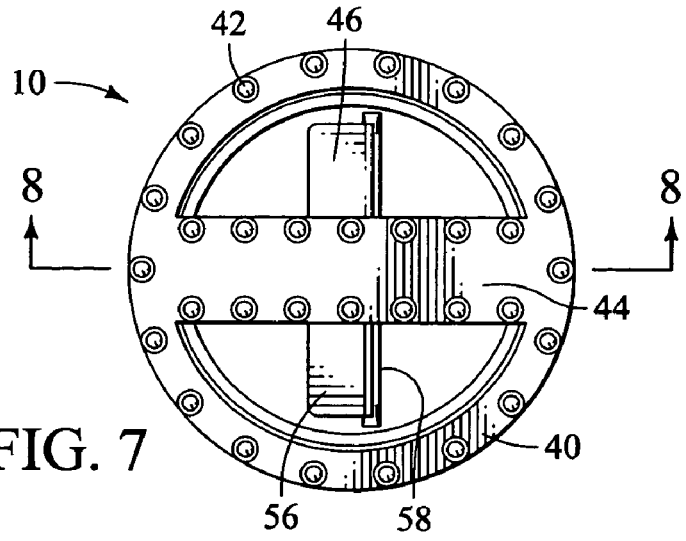
FIG. 7 is a top view of the present attachment shown in a 90-degree offset.

FIGS. 7 and 8 depict a maximum state of oscillation of the pulse valve 46 which occurs when the bar 44 is at a 90-degree offset from the pivot axis 48. The maximum surface area of the bar 44 is exposed to the air flow when the bar is at a right angle, and as such, can deflect more air down at the pulse valve 46. As the pulse valve 46 is increasingly "pushed" down by the deflected air, the value of vectors A' and B' is increased to a maximum amount, and increased surface area of the valve is required for the air from the dryer 16 to "push" up. Thus at a 90-degree offset, the amount of side-to-side movement is maximized for maximum pulse.

During oscillation, the valve 46 does not hit the inside wall of the upper passage 22. In addition to the "pushing" up force of the dryer 16 and the "pushing" down force of the deflected air, friction resistance of the air along the inside wall of the upper passage 22 may create pressure distributions that may aid in preventing the pulse valve from hitting the wall.

The bar 44 is preferably located about 3/16 inch from the free end of the pulse valve 46 when the pulse valve is axially aligned with the passage 22. This distance is relative, given the size and shape of the shell 12, which allows the deflected air to "push" back down on the valve 46. In general, if the distance between the bar 44 and the pulse valve 46 is increased, oscillation decreases and eventually stops. It is also contemplated that, while preferably rotatable relative to the valve 46, the bar 44 may be fixed in any of the non-aligned positions depicted in FIGS. 5 and 7, or other angular dispositions. The ultimate goal, and a feature of the present attachment, is that a steady pulsed flow of hot air is emitted from the dryer barrel 14. Thus, hair can be more readily and quickly dried while reducing damage to the hair.

It will be appreciated that the distance of side-to-side movement and the frequency pulse from the air pulsing attachment 10 will vary depending on such factors as the performance of the dryer being used, the length, shape and diameter of the shell 12, the length, shape and diameter of the dryer nozzle 17, the length, width, shape and distance of the pulse valve 46 from the dryer nozzle 17, the length, width, shape, depth and distance of the bar 44 from the pulse valve 46, and numerous other variables. It is also contemplated that, while preferably rotatable relative to valve 46, the bar 44 may be fixed in any of the non-aligned positions depicted in FIGS. 5 and 7, or other angular positions. The ultimate goal, and a feature of the present attachment is that a steady, pulsed flow of hot air is emitted from the dryer barrel 14. Thus hair can be more readily and quickly dried while reducing damage to the hair. Further, it has been found, through use of the attachment 10, that the warm, pulsed air emitted by the dryer results in a massaging-like effect.

It will be appreciated that although the elements of the air pulsing attachment 10 have particular relative sizes, shapes, positions and dimensions, it will be understood that other embodiments may have different relative sizes, shapes, positions and dimensions. Indeed, it may be desired to vary the shape and/or the dimensions of one or more elements to affect the utility of an attachment embodiment without departing from the invention in its broader aspects.

Other variations on the shapes and sizes of attachments of the invention in addition to those shown and discussed herein will be obvious to those knowledgeable in the art. Manipulation of element sizes and attachment configurations may be made to suit a particular application. For example, the diameter and shape of the shell may be varied to vary air velocity output. Other variations may also be made to suit the needs of a particular application that are not directed to volumetric or velocity output alteration. Various features are set forth in the appended claims.

What is claimed is:

1. An attachment for a handheld dryer of the type that has a barrel through which air flows, the attachment comprising:

a shell attachable to the barrel, having a passage being defined within said shell and an outlet, said passage being in communication with the dryer barrel;

a rigid, generally "Z-shaped" pulse valve being pivotably disposed in said passage, having a pivot axis, a first end fixed to the pivot axis and a second, free end, said pulse valve disposed in said passage for free side-to-side oscillation, wherein said "Z-shape" includes a first leg angled for deflecting barrel air flow and causing movement in a first direction, and a second leg angled for deflecting barrel air flow and causing movement in an opposite direction, said legs causing said pivotal pulse valve to oscillate alternately backward and forward about said pivot axis, and said free end is always closer to said outlet than said pivot end;

at least one deflection member associated with said outlet of said shell, located downstream of said pulse valve, and rotatable with respect to said pivot axis, said at least one deflection member configured for deflecting air from the handheld dryer.

2. The attachment of claim 1 wherein said shell is generally tubular shaped and has a generally circular outlet.

3. The attachment of claim 1 wherein said valve and said at least one deflection member are configured so that a frequency of oscillation is a function of the relative alignment of said deflection member to said pivot axis.

4. The attachment of claim 3 wherein said pulse valve pivots negligibly or is axially aligned with said passage when said deflection member is aligned with said pivot axis.

5. The attachment of claim 3 wherein said pulse valve pivots relative to said shell when said deflection member is not aligned with said pivot axis.

6. The attachment of claim 3 wherein said pulse valve is configured to pivot with variable frequency and variable volumetric output upon exposure to dryer air flow when said deflection member is rotated to positions out of alignment with said pivot axis.

7. The attachment of claim 3 wherein said pulse valve is configured to pivot a maximum amount upon exposure to dryer air flow when said deflection member is at a substantially 90-degree offset from said pivot axis.

8. The attachment of claim 1 wherein said valve and said at least one deflection member are configured so that a frequency of oscillation increases with an increase of non-alignment up to approximately normal (90-degrees) of said deflection member to said pivot axis.

9. The attachment of claim 1 wherein said deflection member is a bar having a width substantially the same as a width of said "Z-shape" of said pulse valve in cross-section.

10. The attachment of claim 1 wherein said deflection member is disposed on a ring rotatably positioned at said outlet.

11. The attachment of claim 1 wherein said passage further includes an upper passage adjacent said outlet, a restriction passage proximate said upper passage, and a lower passage proximate said restriction passage and being configured for receiving the barrel and for communicating air with said restriction passage and said upper passage.

12. The attachment of claim 11 wherein said pulse valve has a length substantially equal to the length of said upper passage.

13. The attachment of claim 11 wherein the barrel has a nozzle end, and wherein said nozzle end has a radius that is substantially the same as the radius of said upper passage.

14. The attachment of claim 11 wherein said restriction passage defines a contraction portion proximate to the barrel and an expansion portion proximate said contraction portion configured for creating a pressure differential in said passage.

15. The attachment of claim 1 wherein the barrel is connected to said shell by at least one releasable locking arrangement.

16. The attachment of claim 1 wherein said shell is configured for attaching the dryer barrel to said shell wherein the dryer barrel extends to about midway along the length of said shell.

17. The attachment of claim 1 wherein said pulse valve further comprises a first leg and a second leg that are substantially the same length.

18. An attachment for a handheld dryer of the type that has a barrel through which air flows, the attachment comprising:

a shell releasably attached to the barrel, a passage being defined within said shell and communicating the air emitted from the dryer with an outlet of said shell, said shell defining a longitudinal axis;

a rigid pulse valve being pivotably disposed in said passage and having a pivot axis, said pivot axis being generally transverse to said longitudinal axis, upon the initiation of air flow in said barrel, said pulse valve being asymmetrically configured in a direction of said air flow to oscillate alternately backward and forward about said pivot axis, said oscillation being sustained and continuous without dampening; and at least one deflection member rotatably mounted in said shell and disposed closer to said outlet than said pulse valve, said at least one deflection member disposable in a non-aligned relationship to said valve and being configured for deflecting air from the handheld dryer back into said passage for causing said pulse valve to oscillate when air flows through the barrel.

19. The attachment of claim 18 wherein said valve and said at least one deflection member are configured so that a frequency of oscillation of said pulse valve depends on the relative surface area of said deflection member that is out of alignment with said pivot axis and the relative width of said pulse valve.

20. An attachment for a handheld dryer of the type that has a barrel through which air flows, the attachment comprising:

a shell releasably attached to the barrel, a passage being defined within said shell and communicating the air emitted from the dryer with an outlet of said shell;

a rigid, pulse valve having a pivot and a "Z-shaped" end opposite said pivot end and located closer to said outlet, being pivotably disposed in said passage and having a pivot axis transverse to a longitudinal axis of said shell; and at least one deflection member associated with said shell and disposed closer to said outlet than said pulse valve, said at least one deflection member configured for deflecting air from the handheld dryer;

wherein said deflection member effects increased frequency of sustained, free non-dampened oscillation of said pulse valve alternately backward and forward about said pivot axis independent of the movement of the handheld dryer by rotating said deflection member from a position aligned with the pivot axis to a non-aligned position, wherein said pulse valve pivots negligibly or is axially aligned with said passage when said deflection member is aligned with said pivot axis, and said pulse valve is configured to pivot a maximum frequency upon exposure to dryer air flow when said deflection member is at a substantially 90-degree offset from said pivot axis.

* * * * *